US008047820B2

(12) United States Patent
Merrick, III

(10) Patent No.: US 8,047,820 B2
(45) Date of Patent: Nov. 1, 2011

(54) STUFFING BOX FOR WALKING BEAM COMPRESSOR

(75) Inventor: Ward S. Merrick, III, Edmond, OK (US)

(73) Assignee: Oil Flow USA, Inc., Harrisonburg, VA (US)

( * ) Notice: Subject to any disclaimer, the term of this patent is extended or adjusted under 35 U.S.C. 154(b) by 838 days.

(21) Appl. No.: 12/056,801

(22) Filed: Mar. 27, 2008

(65) Prior Publication Data

US 2009/0243223 A1 Oct. 1, 2009

(51) Int. Cl.
*F04B 53/00* (2006.01)
*F16J 15/18* (2006.01)

(52) U.S. Cl. ..... 417/555.1; 92/168; 277/513; 277/536

(58) Field of Classification Search ..... 417/555.1; 92/165 R, 168; 277/512, 513, 534, 536, 277/537, 542

See application file for complete search history.

(56) References Cited

U.S. PATENT DOCUMENTS

| | | | | |
|---|---|---|---|---|
| 1,775,733 | A | 9/1930 | Phipps | |
| 2,049,315 | A | 7/1936 | Patterson | |
| 3,010,843 | A | 11/1961 | Eder | |
| 3,655,301 | A | 4/1972 | McClung | |
| 4,153,395 | A | 5/1979 | O'Neill et al. | |
| 4,162,078 | A * | 7/1979 | Cox | 277/539 |
| 4,177,998 | A * | 12/1979 | Laitkep et al. | 277/513 |
| 4,189,157 | A | 2/1980 | Mahan et al. | |
| 4,345,734 | A | 8/1982 | Studinger | |
| 4,466,335 | A | 8/1984 | Milburn, Jr. | |
| 4,530,646 | A | 7/1985 | McCoy | |
| 4,536,134 | A | 8/1985 | Huiber | |
| 4,550,805 | A | 11/1985 | Zimmerman | |
| 4,557,351 | A | 12/1985 | Volk | |
| 4,613,140 | A * | 9/1986 | Knox | 277/329 |
| 4,917,190 | A | 4/1990 | Coppedge | |
| 5,165,699 | A | 11/1992 | Shrontz et al. | |
| 5,209,495 | A | 5/1993 | Palmour | |
| 5,290,156 | A | 3/1994 | Mayland | |
| 5,382,141 | A | 1/1995 | Stinessen et al. | |
| 5,628,516 | A | 5/1997 | Grenke et al. | |
| 5,711,533 | A | 1/1998 | Angelo et al. | |
| 5,845,909 | A | 12/1998 | Angelo et al. | |
| 5,906,354 | A | 5/1999 | Gilbert et al. | |
| 5,975,538 | A | 11/1999 | Krause et al. | |
| 6,012,903 | A | 1/2000 | Boelkins | |
| 6,164,935 | A | 12/2000 | Turiansky | |
| 6,305,918 | B2 | 10/2001 | Turiansky | |
| 6,330,790 | B1 | 12/2001 | Arora et al. | |

(Continued)

FOREIGN PATENT DOCUMENTS

| | | |
|---|---|---|
| EP | 1236896 | 9/2002 |
| JP | 11-201037 | 7/1999 |

*Primary Examiner* — Charles Freay

(74) *Attorney, Agent, or Firm* — Nutter McClennen & Fish LLP

(57) ABSTRACT

Various methods and devices are provided for use in a walking beam compressor used with an oil well pump. In general, an injectable fibrous sealant is provided for use in a stuffing box to form a seal around a piston rod that couples to a walking beam for pumping oil out of the ground. The injectable fibrous sealant can be configured to form a gas tight seal around the piston rod, while allow reciprocal longitudinal movement of the piston rod therethrough. The injectable fibrous sealant is particularly advantageous as it has an extended life, eliminating the need to replace the seal, and repairs can be performed on-site by injecting additional sealant into the stuffing box.

17 Claims, 6 Drawing Sheets

U.S. PATENT DOCUMENTS

| | | | | |
|---|---|---|---|---|
| 6,572,116 | B2 * | 6/2003 | Turiansky | 277/436 |
| 6,752,603 | B2 | 6/2004 | Murase et al. | |
| 2003/0214100 | A1 * | 11/2003 | Pippert | 277/510 |
| 2004/0035574 | A1 * | 2/2004 | Pippert | 166/90.1 |
| 2005/0230106 | A1 * | 10/2005 | Mahoney et al. | 166/244.1 |
| 2007/0157799 | A1 | 7/2007 | Cochran et al. | |

* cited by examiner

Prior Art

FIGURE 4A
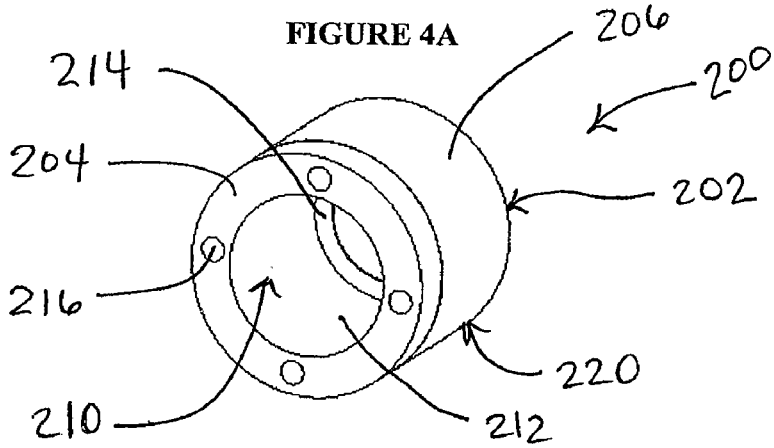
FIGURE 4B
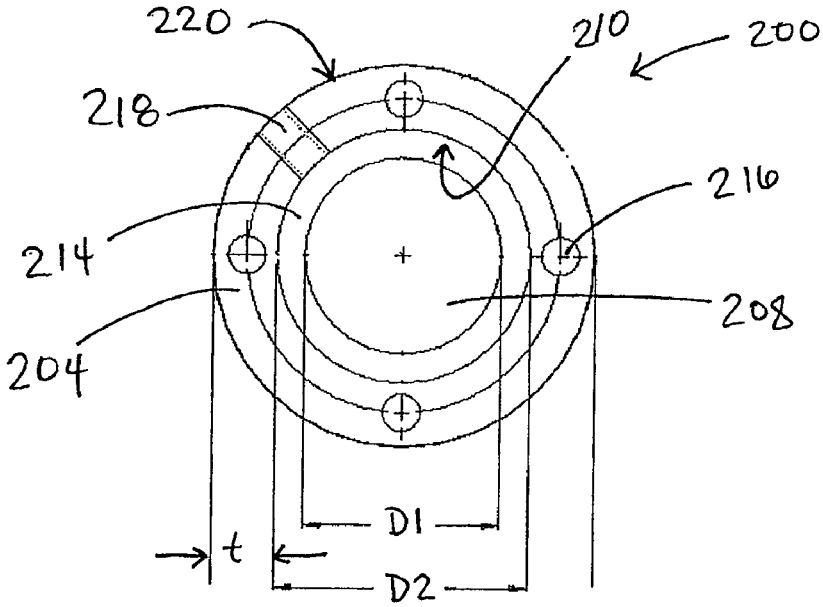
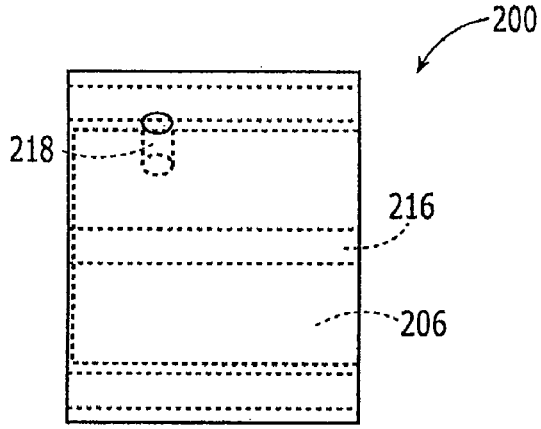
FIGURE 4C

STUFFING BOX FOR WALKING BEAM COMPRESSOR

FIELD OF THE INVENTION

The present invention relates to gas compressors to be used with oil wells, and in particular to a piston rod seal assembly for use in a walking beam compressor and methods for manufacturing the same.

BACKGROUND OF THE INVENTION

A common oil well pumping system includes a walking beam mounted upon a horizontally-axised, transverse pivot at the top of a Samson post. One end of the walking beam is connected to a pump rod and the other end is connected to the crank of a drive motor through a connecting rod. Rotation of the crank causes the walking beam to rock or oscillate in a vertical plane to raise and lower the pump rod. The rod-connected end of the walking beam is provided with the familiar "horse head" to keep the pump rod in alignment with the well axis. The opposite end of the walking beam carries a counterbalance weight to offset the weight of the pump rod and minimize the stress on the motor.

When pumping an oil well, both oil and gas may be produced and the capture of the gas is both profitable and better for the environment. Thus, an oil well pumping system can include a compressor unit mounted between the walking beam and a stationary part of the pumping unit for compressing the natural gas produced during the pumping of the oil. Such a compressor unit is called a walking beam compressor because it is activated by engaging a piston rod coupled to the walking beam. The rocking of the walking beam reciprocates the piston to effect intake and compression strokes. As a compressing mechanism compresses the gas, high pressures are created inside the compressor housing, requiring appropriate sealing elements between the compressor housing, the piston rod, and the atmosphere. Traditionally, a piston rod seal may have rubber sealing elements that tend to wear quickly and require replacement. Accordingly, there is a need for an improved piston rod seal assembly that can provide effective sealing between the walking beam compressor and the atmosphere while having an extended lifetime.

SUMMARY OF THE INVENTION

The present invention generally provides a seal for use in a piston rod seal assembly. In one embodiment, a stuffing box is provided having a cylindrical housing defining a lumen extending therethrough between top and bottom ends thereof. The lumen can be filled with an injectable fibrous sealant that is configured to form a seal around a piston rod extending through the bore and through the injectable fibrous sealant.

While various injectable fibrous sealant materials can be used, in one exemplary embodiment the injectable fibrous sealant is U-PAK® Injectable Sealant. The sealant can be pre-formed into a cylindrical seal having a bore formed therethrough and coaxial with the bore in the flange such that a piston rod can extend through the bore in the flange and through the bore in the cylindrical seal. In an exemplary embodiment, the bore formed in the cylindrical seal has a diameter that is less than a diameter of the bore formed in the flange.

The cylindrical seal can have a variety of configurations. In one embodiment, the cylindrical seal can be pre-disposed within the cavity, and any gaps formed between the cylindrical seal and an inner surface of the cylindrical housing are filled with additional injectable fibrous sealant injected into the lumen. In certain exemplary embodiments, the injectable fibrous sealant is under pressure when disposed within the lumen. The cylindrical seal can also include top and bottom pressure rings disposed on top and bottom end walls thereof and configured to prevent injectable fibrous sealant from leaking out of the lumen in the cylindrical housing. The top and bottom pressure rings can have, for example, a substantially A-shaped cross-section.

The cylindrical housing can also have a variety of configurations. In one exemplary embodiment, the top end of the housing can include a flange defining a bore coaxial with the lumen and having a diameter less than a diameter of the lumen. In another embodiment, the housing can include a plurality of holes extending therethrough between the top and bottom ends thereof for receiving a plurality of fastening elements therethrough. The housing can also include port can extend through the housing and configured to allow the injectable fibrous sealant to be injected into the cavity.

In another embodiment, an oil well pump is provided and includes a walking beam for pumping oil out of the ground, a piston rod mated to the walking beam, and a compressor disposed around the piston rod and configured to receive and compress gas contained with oil pumped out of the ground. An injectable sealant can be coupled to the compressor and concentrically positioned around the piston rod extending through the compressor to form a gas-tight seal around the piston rod.

In one exemplary embodiment, the injectable sealant can be U-PAK® Injectable Sealant. The piston rod extends through a bore formed in the injectable sealant, and the injectable sealant can be disposed within a stuffing box coupled to the compressor. The stuffing box can have a lumen formed therethrough that slidably receives the piston rod. In certain aspects, the injectable sealant can be pre-formed into a cylindrical sealing element having a bore formed therethrough that is co-axial with the lumen in the stuffing box and that for receives the piston rod. The cylindrical sealing element can pre-disposed within the stuffing box, and any gaps formed between the cylindrical sealing element and the stuffing box and piston rod are filled with additional injectable sealant injected into the stuffing box.

In other aspects, the stuffing box can include a top flange having a bore formed therein that receives the piston rod. In an exemplary embodiment, the bore in the flange has a diameter that is smaller than a diameter of the lumen in the stuffing box. The stuffing box can also include a plurality of fastener holes extending through a sidewall thereof, and/or a port extending through a sidewall thereof for delivering the injectable fibrous sealant into the lumen.

In other aspects, methods of manufacturing a piston rod seal assembly are provided, and in one embodiment the method can include forming a seal from an injectable fibrous sealant composition, positioning the seal within a housing, positioning a piston rod through the seal such that the piston rod is slidably movable relative to the housing and seal, and injecting additional injectable fibrous sealant composition into the housing to cause a pressurized seal to be formed around the piston rod. Injecting additional injectable fibrous sealant composition into the housing can fill all gaps between the seal, the housing, and the piston rod. In use, the seal can be configured to allow for longitudinal reciprocal movement of the piston rod therethrough while maintaining a gas-tight seal around the piston rod.

In one exemplary embodiment, forming a seal can include forming a cylindrical member having a bore formed therethrough. The cylindrical member can have a width from an outer surface to an inner surface thereof that corresponds to a distance between an interior wall of the housing and the piston rod. The method can also include mating top and bottom pressure rings to the seal. The pressure rings can prevent the injectable fibrous sealant composition from leaking out of the housing. Top and bottom washers can also be positioned adjacent to the top and bottom pressure rings. The method can further include coupling the housing to a compressor and coupling the piston rod to a walking beam that pumps oil out of the ground.

BRIEF DESCRIPTION OF THE DRAWINGS

The invention will be more fully understood from the following detailed description taken in conjunction with the accompanying drawings, in which:

FIG. 4A is a perspective view of the stuffing box of FIG. 3;

FIG. 4B is a top view of the stuffing box of FIG. 4A;

FIG. 4C is a side view of the stuffing box of FIG. 4A;

DETAILED DESCRIPTION OF THE INVENTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

The present invention generally provides a piston rod seal assembly for use in a walking beam compressor and methods for manufacturing the same. In general, the piston rod seal assembly includes an injectable fibrous sealant that is configured to form a seal around a piston rod movably disposed through a stuffing box in a walking beam compressor. The use of an injectable fibrous sealant is particularly advantageous as it allows a gas tight seal to be formed around the piston rod and between the walking beam compressor, the piston rod, and the atmosphere. Moreover, the injectable seal has an extended life relative to prior art rubber sealing elements.

Figure 1:
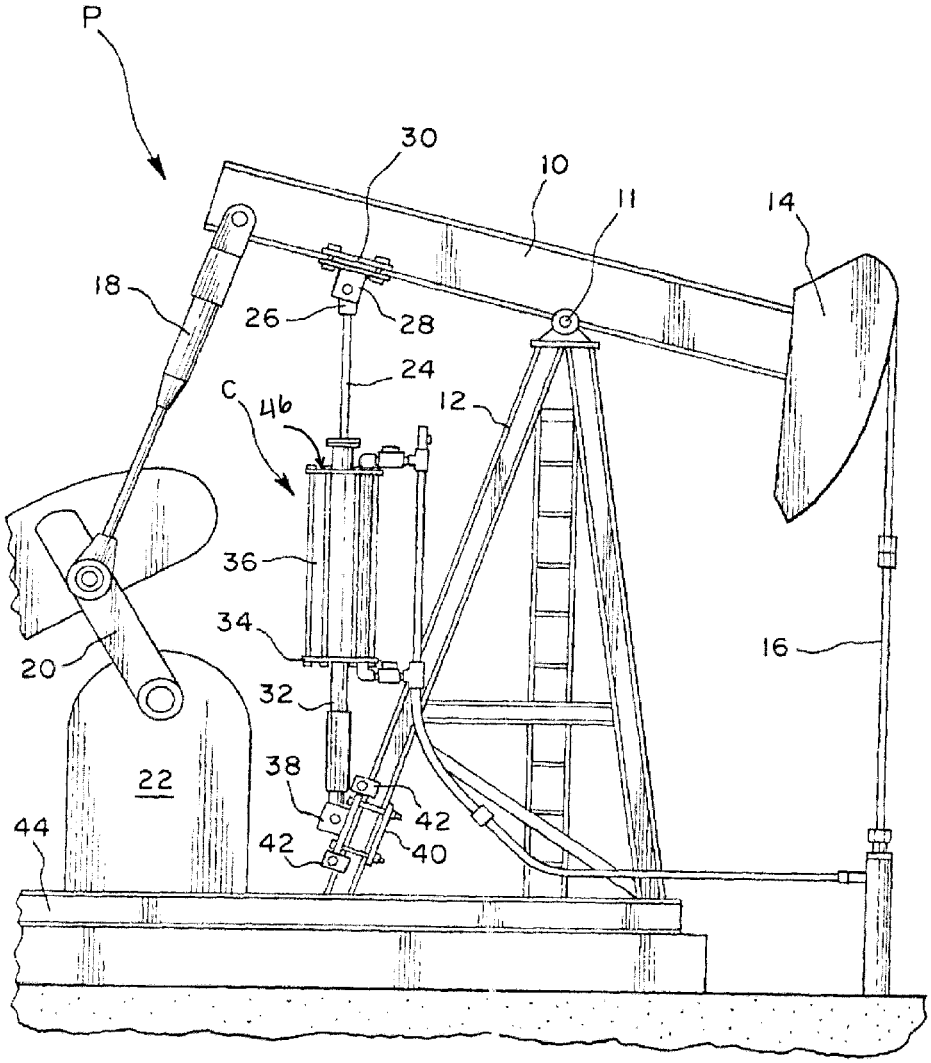
FIG. 1 is a side view of one embodiment of an oil pump having a compressor and piston rod seal assembly coupled thereto.

FIG. 1 shows one embodiment of an oil well pump P having a compressor C mounted thereon. As shown, the oil well pump P generally includes a walking beam 10 pivotally mounted to a top of a Samson post 12 by a bearing 11. A horsehead 14 on one end of the walking beam 10 can be connected to a rod 16 for operating a downhole pumping system as is well understood in the oil production industry. A connecting rod 18 can be connected through a linkage 20 to a gear box 22 which drives the pump P. The compressor C can have a piston rod 24 attached at its upper end to a coupling 26 that is pivotally mounted in a bracket 28 and attached to the walking beam 10 by another bracket 30. The compressor C can also have a lower cover plate 34 with a lower support leg 32 coupled thereto and extending therebetween. A bottom portion of the support leg 32 can be pivotally connected to a bracket 38 attached to a leg of the Samson post 12 by a clamp 40. Additional clamps 42 can be provided at each end of clamp 40, as shown, to minimize possible movement of the clamp 40 along the leg of Samson post 12 during the pumping operation. It will be appreciated by those skilled in the art that the lower cover plate 34, and hence the bottom portion of the compressor, can be coupled to any stationary portion of the oil well pump P as needed. For example, the lower cover plate 34 can also be attached to a base 44, if desired. Exemplary oil well pumps and compressors are described in more detail in U.S. Pat. No. 6,572,116 of Turiansky, U.S. Pat. No. 6,164,935 of Turiansky, and U.S. Pat. No. 6,305,918 of Turiansky, incorporated herein by reference in their entireties.

Figure 2:
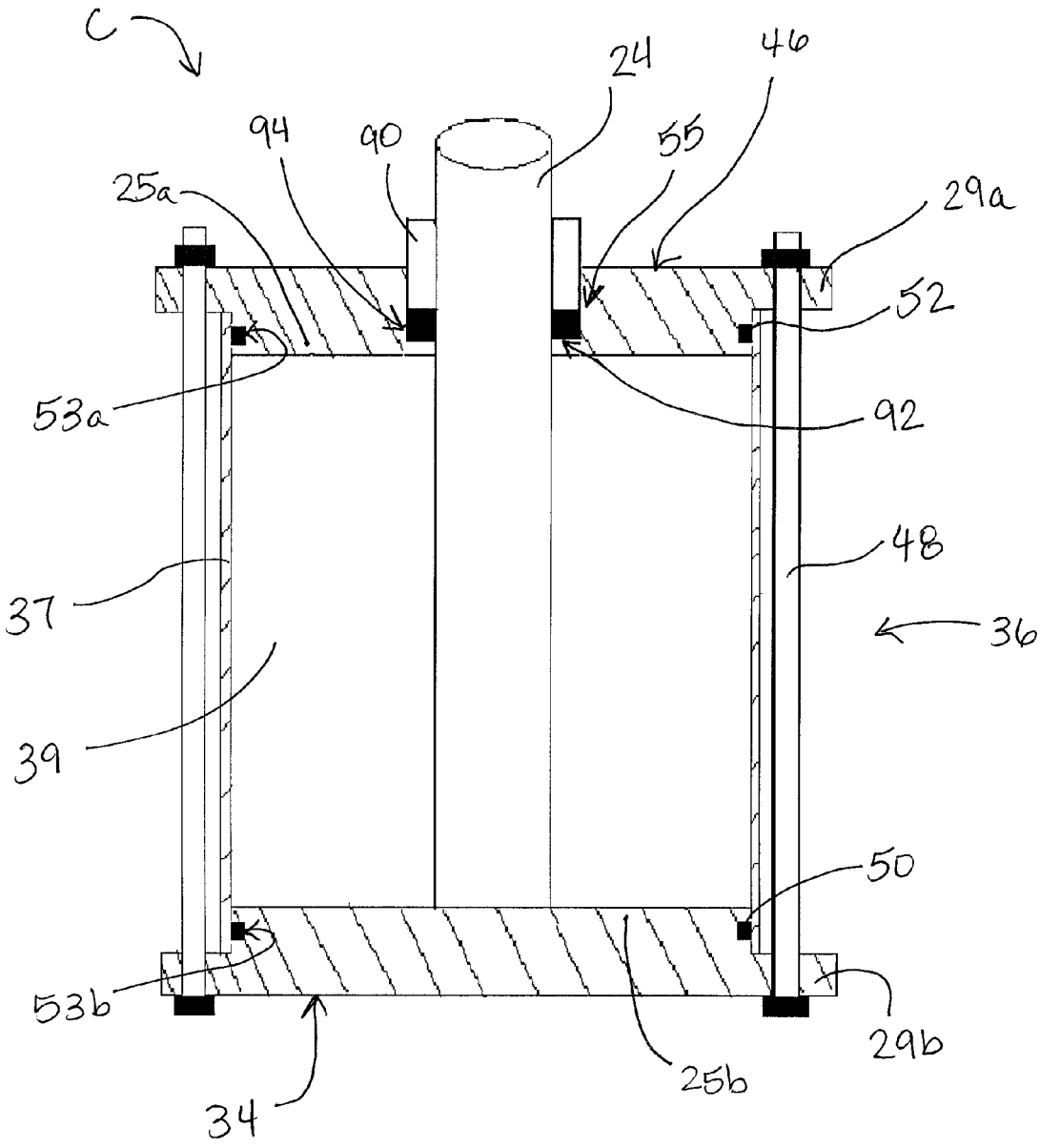
FIG. 2 is a cross-sectional view of an outer housing of the compressor and piston rod seal assembly of FIG. 1.

As further shown in FIG. 1, the compressor C can include a cylindrical housing 36 extending between the lower cover plate 34 and an upper cover plate or cap 46. As shown in more detail in FIG. 2, the cap 46 and the lower cover plate 34 can each have a circular shape with smaller diameter portions 25*a*, 25*b* that extend into open top and bottom ends of the cylindrical housing 36. The cap 46 and the lower cover plate 34 can also have larger diameter portions such that peripheral flanges 29*a*, 29*b* are formed to rest against top and bottom end walls or rims of the cylindrical housing 36. The cap 46 can be attached to the cylindrical housing 36 by one or more bolts 48 spaced about and extending through the peripheral flange 29*a* of the cap 46 and the peripheral flange 29*b* of lower cover plate 34, as shown. Both the cap 46 and the lower cover plate 34 can also include peripheral recesses 53*a*, 53*b* formed in the smaller diameter portions 25*a*, 25*b* for receiving o-rings 50, 52 to form a fluid-tight seal between the smaller diameter portions 25*a*, 25*b* and the inner surface of cylindrical housing 36. As further shown, the cap 46 can include a central bore 55 with a large diameter proximal portion formed therein for seating the piston rod seal assembly 90 and a smaller diameter distal portion sized to receive the piston rod 24 extending through the piston rod seal assembly 90. The piston rod seal assembly 90 can be positioned just proximal of a lower annular insert 94. In this way, the piston rod seal assembly 90 is seated within the cap 46 and positioned around the piston rod 24 extending through the cap 46 for forming a fluid and gas tight seal between an interior chamber 39 of the compressor C, the piston rod 24, and the atmosphere. A rod collar assembly can be fastened to the cap 46 and over and around the piston rod seal assembly 90, as will be appreciated by those skilled in the art. While not shown here, the interior chamber 39 contains components for receiving and compressing natural gas, as will be fully appreciated by those skilled in the art and as can be seen in the patents incorporated herein by reference.

Figure 3:
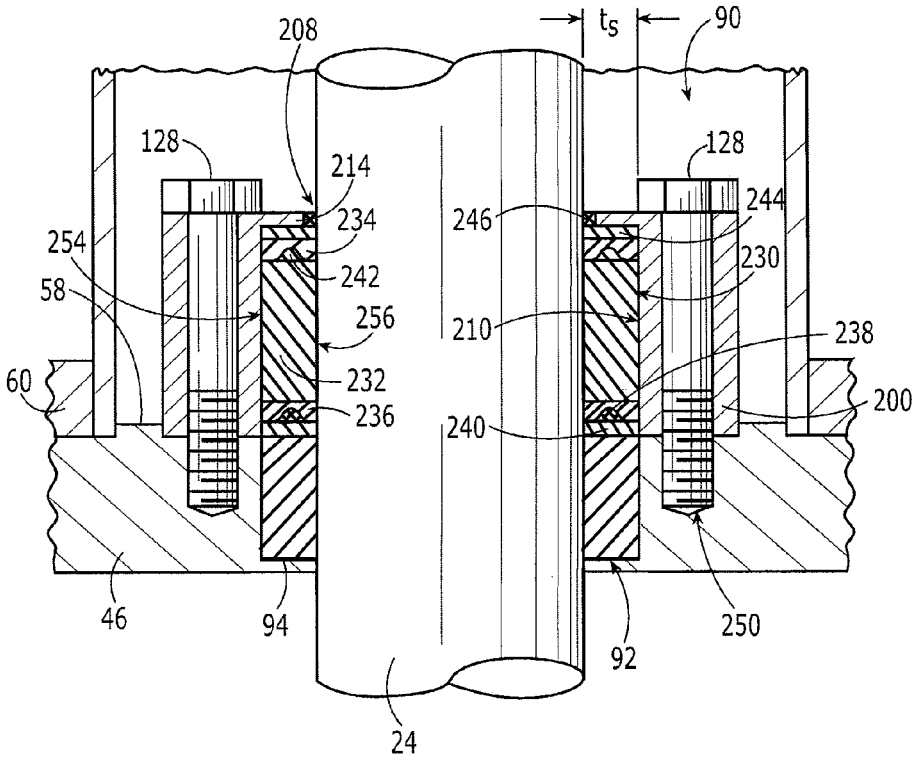
FIG. 3 is a cross-sectional view of the piston rod seal assembly of FIG. 1 having a stuffing box coupled thereto.

In one embodiment as shown in FIG. 3, the piston rod seal assembly 90 can generally include a cylindrical housing or stuffing box 200 having a sealing mechanism 230 therein. The stuffing box 200 is generally provided as a housing to enclose the sealing mechanism 230 that is disposed inside and around the piston rod 24. In particular, as shown in FIGS. 4A-4C, the stuffing box 200 can have a generally hollow configuration with a lumen extending therethrough between top and bottom ends 202, 204. The stuffing box 200 can be formed from any materials known in the art able to withstand a pressurized environment, including but not limited to stainless steel and/ or titanium. While the shape and the size of the stuffing box 200 can vary, in the illustrated embodiment the stuffing box 200 has a generally elongate cylindrical-shaped sidewall 206 defining a thickness t. Each end wall 202, 204 can have a bore formed therethrough with a sidewall 206 extending therebetween and defining a thickness t. The thickness t of the sidewall 206 can vary depending on the size and pressure requirements of the system, but in one embodiment, it can be sufficient to receive and support retaining rods, fastening members, and/or bolts for securing the stuffing box 200 to the cap 46 as discussed below. The sidewall 206 can define an interior cavity 210 for receiving and holding the sealing mechanism 230.

As further shown in FIGS. 4A and 4B, the top end 202 can include a lip or flange 214 formed therein and defining a bore 208 with a diameter D1 that is smaller than an inner diameter D2 of the sidewall 206, i.e., the diameter of the cavity 210. The diameter D1 of the bore 208 formed through the top flange 214 can also be only slightly larger than a diameter of the piston rod 24 extending therethrough, leaving room for a wear or o-ring 246 (shown in FIG. 3) to be positioned between the top end bore 208 and the piston rod 24. When assembled, the flange 214 will extend over a top portion of the sealing mechanism 230 (shown in FIG. 6) and mate with the o-ring 246 to provide a tight fit between the top end bore 208 and the piston rod 24. The bottom end 204 of the stuffing box 200 can have the same inner diameter D2 of the sidewall 206 of the stuffing box 200. In other words, the bottom end 204 of the stuffing box 200 can be open. The inner diameter D2 of the sidewall 206 can be only slightly larger than a diameter of the sealing mechanism 230

When assembled, the bottom end 204 can be configured to sit on top of the lower annular insert 94 and within the cylindrical cavity 92 formed in the cap 46, shown in FIG. 3. The stuffing box 200 can fixedly mate to the cap 46 and various mating techniques known in the art can be used. In one exemplary embodiment, as shown, one or more fastening holes or bolt holes can be spaced, preferably circumferentially, and formed through the sidewall 206 of the stuffing box 200 extending between top and bottom ends 202, 204. In the illustrated example, the stuffing box 200 includes four bolt holes 216 evenly spaced around the circumference of the sidewall 206. Fastening elements, such as bolts 128, can be disposed within the holes 216 to extend through the sidewall 206 and into corresponding receiving holes 250 disposed in the cap 46. The receiving holes 250 can have a threaded inner surface for receiving the bolts 128.

As shown in FIG. 4C, the stuffing box 200 can also include one or more lumens or ports 218 formed in the sidewall 206 thereof, extending from an exterior surface 220 of the stuffing box 200 through the sidewall 206 and into the cavity 210. The port 218 can be configured for delivering additional injectable fibrous sealant into the cavity 210, as will be described in more detail below. A check-valve or button head fitting can be positioned inside the port 218 to facilitate delivery of the injectable fibrous sealant under pressure via a pneumatic grease gun or other pressurized injecting mechanism known in the art.

As indicated above, the piston rod seal assembly 90 can also include a sealing element 232 disposed within the stuffing box 200. While the sealing element 232 can have various configurations and can be formed of any material known in the art able to withstand the pressurized environment while providing a lubricating seal around the piston rod 24, a particularly effective material for use in this way is an injectable fibrous sealant such as UPAK® Industrial Sealant manufactured by UTEX Industries, Inc. Thus, in one exemplary embodiment, the cylindrical sealing element 232 can be pre-formed of UPAK® Industrial Sealant and positioned inside the stuffing box 200 to provide a lubricating, fibrous, and solid material that is able to seal around the piston rod 24 within a pressurized environment. A sealing element 232 formed from an injectable fibrous sealant provides a seal that will have very low wear and will not require frequent replacement like rubber or composite seals. The sealing mechanism can be initially placed under pressure to form a gas-tight seal by injecting (e.g., through the port 218) additional sealant into the cavity and around the sealing element 232. Should any wear occur between the sealing element 232 and the piston rod 24, however, additional sealant can be injected into the cavity as needed and on multiple occasions to maintain required sealing pressures. This injecting of additional sealant can be performed "in the field" at the oil well pump, without having to disassemble the walking beam compressor. This is particularly time and cost effective and can thereby provide an extended lifetime for the piston rod seal assembly.

While many combinations of sealing mechanisms and components are possible, in the embodiment shown in FIG. 3, the sealing mechanism 230 can include the pre-formed cylindrical sealing element 232 formed from an injectable fibrous sealant as described above. The cylindrical sealing element 232 can have a diameter that is smaller than a diameter of the stuffing box 200 so that the sealing element 232 can fit within the cavity 210 of the stuffing box 200, and it can include a bore 252 formed therethrough for receiving the piston rod 24. A wall thickness ts of the sealing element 232, as measured from an outer surface 254 to an interior surface 256 that defines the bore 252, can be such that there is a tight fit between the interior surface 256 of the cylindrical sealing element 232 and the piston rod 24. The sealing element 232 can be positioned anywhere within the stuffing box 200 as needed, but in one exemplary embodiment, the sealing element 232 is positioned between a top annular flat-back pressure ring 234 and a bottom annular flat-back pressure ring 236, such as that shown in FIG. 5. The top and bottom pressure rings 234, 236 can be configured to be positioned adjacent to top and bottom surfaces of the sealing element 232, thereby preventing the injectable fibrous sealant from leaking out once the system is placed under pressure with additional sealant added through the port 218. The top and bottom pressure rings 234, 236 can have a thickness, as measured between inner and outer surfaces thereof, that is substantially the same as a thickness of the sealing element 232, allowing the pressure rings 234, 236 to act with the interior surface 212 of the stuffing box 200 and the piston rod 24 to essentially form a complete cylindrical enclosure that occupies the entire lumen 210 in the stuffing box 200 thus retaining the sealing element 232 and any additional injectable fibrous sealant therein.

Figure 5:
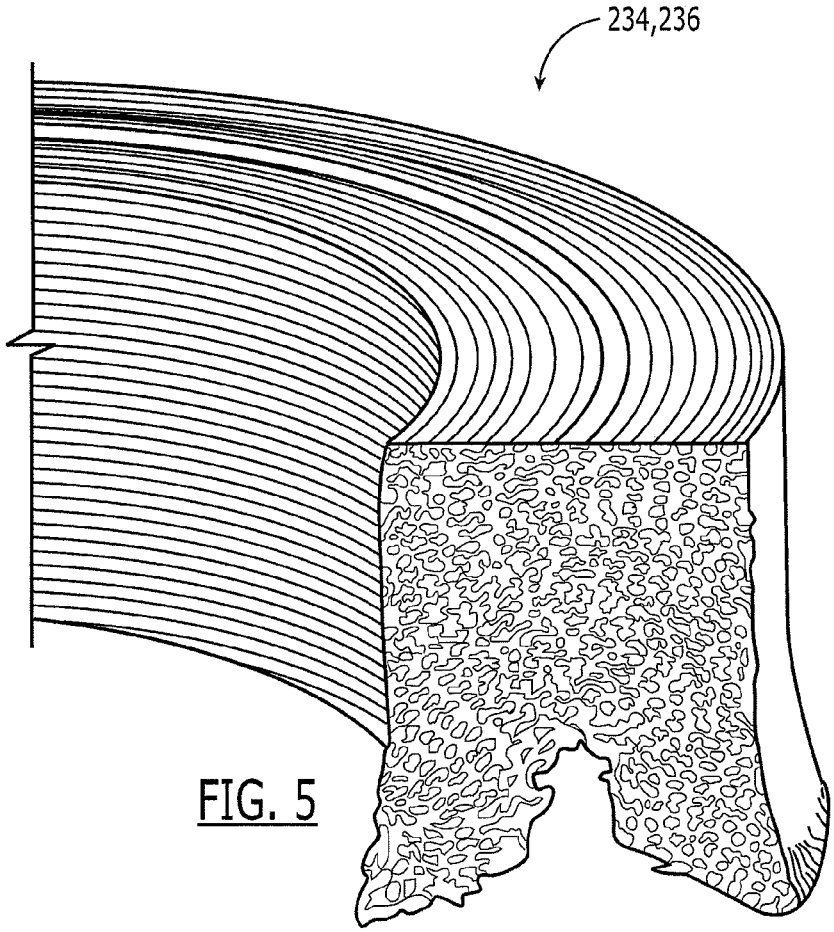
FIG. 5 is a cross-sectional view of a pressure ring of the piston rod seal assembly of FIG. 3.

The top and bottom pressure rings 234, 236 can also be mated to other components within the sealing mechanism 230. In one embodiment, the top and bottom pressure rings 234, 236 can have a substantially A-shaped cross-section as shown in FIG. 5. A generally A-shaped adapter 238 can be used to mate the bottom pressure ring 236 with a bottom annular washer 240, as shown in FIG. 3. The A-shaped adapter 238 can have an upper portion that generally matches the profile of the pressure ring 236 and a generally planar portion to provide a flush surface for mating with the generally flat surface of the washer 240. The bottom washer 240 can be positioned between the adapter 238 and the lower annular insert 94. The A-shaped space 242 created by the top pressure ring 234 can be filled with additional injectable fibrous sealant when the system is placed under pressure.

Figure 6:
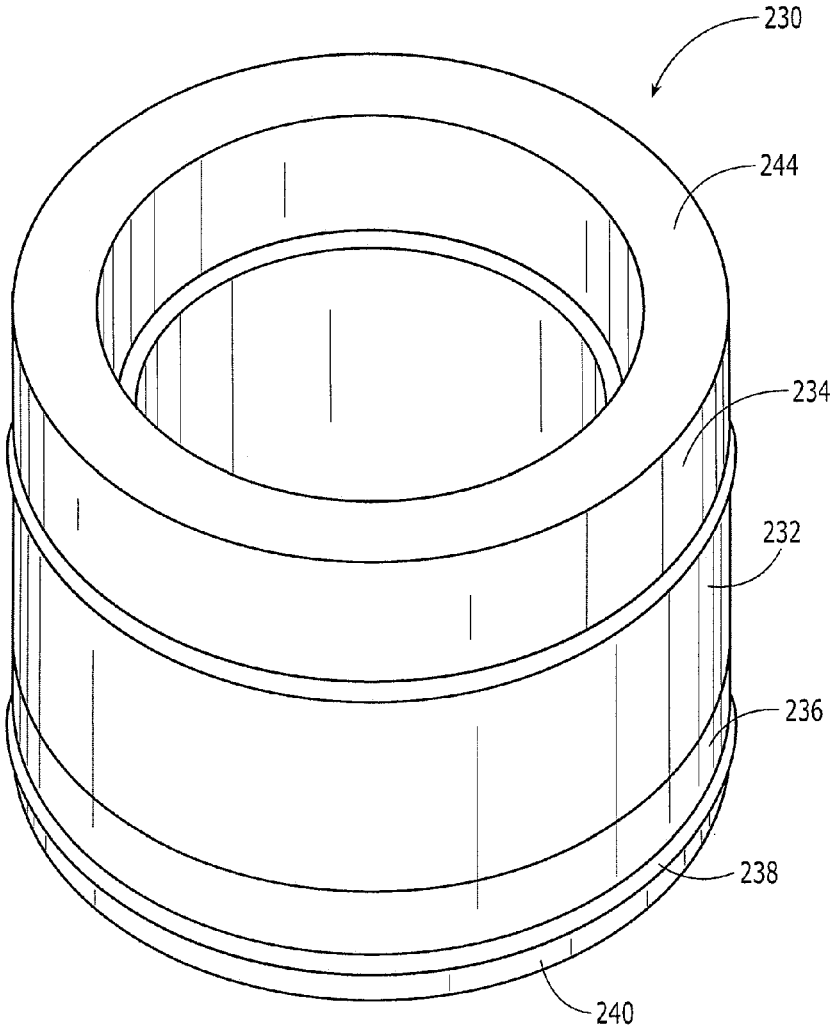
FIG. 6 is a perspective view of a seal of the piston rod seal assembly of FIG. 3, showing the pressure ring of FIG. 5 coupled thereto.

There can also be a top annular washer 244 positioned between the flange 214 on the stuffing box 200 and the top pressure ring 234. The pressure rings 234, 236 can be formed of any material known in the art able to withstand the required pressures, including but not limited to, Kevlar. In addition, the washers 240, 244 can be formed of any suitable material known in the art, and in one embodiment, the washers are aluminum bronze washers. FIG. 6 illustrates one embodiment of an assembled sealing mechanism 230, showing the top and bottom washers 244, 240; the top and bottom pressure rings 234, 236; the cylindrical sealing element 232; and the adapter 238.

Methods for manufacturing a piston rod seal assembly are also provided. In one embodiment, a seal is formed from an injectable fibrous sealant composition and positioned within a housing. A piston rod can be positioned through the housing and the seal such that the piston rod is slidably movable relative to the housing and seal. Additional injectable fibrous sealant composition can be injected into the housing to cause a pressurized seal to be formed around the piston rod.

More particularly, a housing or stuffing box can be machined into a generally cylindrical form. For example, as described in the exemplary embodiments above. In addition, a sealing mechanism can be assembled to be positioned inside the stuffing box. For example, a cylindrical sealing element can be pre-formed from an injectable fibrous sealant composition that is configured to provide lubrication and a pressurized seal around a piston rod. The cylindrical sealing element can be pre-formed to have a cylindrical size and shape that corresponds to a size and shape of an interior cavity within the stuffing box. The sealing mechanism can include other sealing components adapted to secure the cylindrical sealing element within the stuffing box. For example, as indicated above, annular pressure rings can be positioned on top and bottom surfaces of the cylindrical sealing element to prevent any additionally added sealant from leaking out when the system is placed under pressure. Top and bottom washers can be positioned adjacent to the pressure rings as described in detail above to facilitate seating the assembled sealing components inside the housing. Adapters can be included as needed between the bottom pressure ring and the bottom washer. The assembled sealing mechanism can be positioned inside the stuffing box to occupy the entire lumen in the stuffing box and form the assembled piston rod seal assembly. The sealing mechanism can be positioned inside the housing such that the top washer is positioned adjacent to a top flange portion of the stuffing box. The bottom washer can be positioned flush with the bottom end of the stuffing box.

The assembled piston rod seal assembly can be positioned adjacent to a lower annular insert within a top cap of a walking beam compressor and around a piston rod so that the piston rod is configured for reciprocal longitudinal movement therethrough relative to the piston rod seal assembly. Once the piston rod seal assembly is positioned adjacent to the lower annular insert, a fastening mechanism, such as retaining rods or bolts, can be inserted into receiving holes extending through a sidewall of the stuffing box and into corresponding holes within the cap of the walking beam compressor. Once the piston rod seal assembly is assembled and secured to the compressor and around the piston rod, a pneumatic grease gun or other injecting mechanism can be used to inject additional injectable fibrous sealant through a port and button head fitting within a sidewall of the stuffing box and into an interior portion of the stuffing box to fill in space around the cylindrical sealing element and to place the entire system under pressure. The system can be pressurized up to and including a pressure of 8,000 pounds to ensure a proper seal is formed. The system can be subsequently re-pressurized as needed to maintain the seal over time.

In use, the piston rod is connected to a walking beam of an oil well pump. Thus, the piston rod is configured for reciprocal movement in response to rocking of the walking beam as it acts to pump oil out of the ground. The reciprocating motion of the piston rod is effective to facilitate the compression of gas within the walking beam compressor having the piston rod seal assembly coupled to a top portion thereof. The piston rod is therefore moving in and out of a highly pressurized environment (within the walking beam compressor) and the piston rod seal assembly provides the transition between the compressor and the environment. The piston rod seal assembly will therefore provide a fluid and gas tight seal around the reciprocating piston rod between the walking beam compressor and the atmosphere.

A person skilled in the art will appreciate that, while the exemplary method described in connection with the particular embodiments disclosed herein, the method can vary significantly depending on the particular configuration of the piston rod seal assembly as well as the walking beam compressor.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A stuffing box for use in a piston rod seal assembly, comprising:

a cylindrical housing defining a lumen extending therethrough between top and bottom ends thereof, the top end including a flange defining a bore coaxial with the lumen and having a diameter less than a diameter of the lumen, the lumen being filled with:

a to pressure ring adjacent to the to end of the cylindrical housing;

a bottom pressure ring adjacent to the bottom end of the cylindrical housing; and an injectable fibrous sealant that is configured to form a seal around a piston rod extending through the bore and through the injectable fibrous sealant;

wherein the to pressure ring and the bottom pressure ring have a generally planar surface and an opposite surface with a groove formed therein, wherein the surfaces with the groove are facing the same direction.

2. The stuffing box of claim 1, wherein the injectable fibrous sealant is in the shape of a cylindrical seal having a bore formed therethrough and coaxial with the bore in the flange such that a piston rod can extend through the bore in the flange and through the bore in the cylindrical seal.

3. The stuffing box of claim 2, wherein the bore formed in the cylindrical seal has a diameter that is less than a diameter of the bore formed in the flange.

4. The stuffing box of claim 2, wherein the cylindrical seal is disposed within the lumen, and any gaps formed between the cylindrical seal and an inner surface of the cylindrical housing are filled with additional injectable fibrous sealant injected into the lumen.

5. The stuffing box of claim 1, wherein the cylindrical housing includes a port extending therethrough and configured to allow the injectable fibrous sealant to be injected into the cavity.

6. The stuffing box of claim 1, wherein the injectable fibrous sealant is under pressure.

7. The stuffing box of claim 1, wherein the cylindrical housing includes a plurality of holes extending therethrough between the top and bottom ends thereof for receiving a plurality of fastening elements therethrough.

8. The stuffing box of claim 1, wherein the cylindrical housing includes the top and bottom pressure rings disposed on top and bottom end walls thereof and configured to prevent injectable fibrous sealant from leaking out of the lumen in the cylindrical housing.

9. The stuffing box of claim 8, wherein the top and bottom pressure rings have a substantially A-shaped cross-section.

10. An oil well pump, comprising:

a walking beam for pumping oil out of the ground;

a piston rod mated to the walking beam;

a compressor disposed around the piston rod and configured to receive and compress gas contained with oil pumped out of the ground;

stuffing box having to and bottom ends coupled to the compressor and concentrically positioned around the piston rod extending through the compressor;

wherein the stuffing box contains a to pressure ring adjacent to the to end of the stuffing box, a bottom pressure ring adjacent to the bottom end of the stuffing box, and an injectable sealant configured to form a gas-tight seal around the piston rod; and wherein the to pressure ring and the bottom pressure ring have a generally planar surface and an opposite surface with a groove formed therein, wherein the surfaces with the groove are facing the same direction.

11. The oil well pump of claim 10, wherein the piston rod extends through a bore formed in the injectable sealant.

12. The oil well pump of claim 10, wherein the injectable sealant is disposed within a stuffing box coupled to the compressor, the stuffing box having a lumen formed therethrough that slidably receives the piston rod.

13. The oil well pump of claim 12, wherein the injectable seal is in the shape of a cylindrical sealing element having a bore formed therethrough that is co-axial with the lumen in the stuffing box and that for receives the piston rod.

14. The oil well pump of claim 13, wherein the cylindrical sealing element is disposed within the stuffing box, and any gaps formed between the cylindrical sealing element and the stuffing box and piston rod are filled with additional injectable sealant injected into the stuffing box.

15. The oil well pump of claim 12, wherein the stuffing box includes a top flange having a bore formed therein that receives the piston rod, the bore in the flange having a diameter that is smaller than a diameter of the lumen in the stuffing box.

16. The oil well pump of claim 12, wherein the stuffing box includes a plurality of fastener holes extending through a sidewall thereof.

17. The oil well pump of claim 12, wherein the stuffing box includes a port extending through a sidewall thereof for delivering the injectable fibrous sealant into the lumen.

* * * * *

UNITED STATES PATENT AND TRADEMARK OFFICE

CERTIFICATE OF CORRECTION

PATENT NO. : 8,047,820 B2
APPLICATION NO. : 12/056801
DATED : November 1, 2011
INVENTOR(S) : Ward S. Merrick III It is certified that error appears in the above-identified patent and that said Letters Patent is hereby corrected as shown below:

In the Claims

Claim 1, column 8, line 38, delete the word "to"

Claim 1, column 8, line 45, delete the word "to"

Claim 9, column 9, line 18, delete the words "to" and "and"

Claim 9, column 9, line 21, delete the word "to"

Claim 9, column 9, line 22, delete the word "to"

Claim 9, column 9, line 26, delete the word "to"

Signed and Sealed this
Twenty-ninth Day of April, 2014

Michelle K. Lee

Michelle K. Lee
*Deputy Director of the United States Patent and Trademark Office*